US012643700B2

(12) United States Patent
Ragno

(10) Patent No.: US 12,643,700 B2
(45) Date of Patent: Jun. 2, 2026

(54) HORIZONTAL PACKAGING APPARATUS

(71) Applicant: ILAPAK INTERNATIONAL SA, Collina d'Oro (CH)

(72) Inventor: Nicola Ragno, Collina d'Oro (CH)

(73) Assignee: ILAPAK INTERNATIONAL SA, Collina d'Oro (CH)

( * ) Notice: Subject to any disclaimer, the term of this patent is extended or adjusted under 35 U.S.C. 154(b) by 0 days.

(21) Appl. No.: 18/698,576

(22) PCT Filed: Oct. 7, 2022

(86) PCT No.: PCT/IB2022/059615
§ 371 (c)(1),
(2) Date: Apr. 4, 2024

(87) PCT Pub. No.: WO2023/062493
PCT Pub. Date: Apr. 20, 2023

(65) Prior Publication Data

US 2025/0236426 A1 Jul. 24, 2025

(30) Foreign Application Priority Data

Oct. 13, 2021 (IT) ..... 102021000026198

(51) Int. Cl.
*B65B 59/00* (2006.01)
*B65B 9/06* (2012.01)
(Continued)

(52) U.S. Cl.
CPC ..... *B65B 59/003* (2019.05); *B65B 9/06* (2013.01); *B65B 41/16* (2013.01); *B65B 51/306* (2013.01); *B65B 61/06* (2013.01); *B65B 35/24* (2013.01)

(58) Field of Classification Search
CPC ... B65B 9/06–073; B65B 9/22; B65B 59/003; B65B 41/16; B65B 51/306; B65B 61/06
See application file for complete search history.

(56) References Cited

U.S. PATENT DOCUMENTS 4,494,362 A * 1/1985 Koch ..... B65B 9/06 53/550
4,519,185 A * 5/1985 Horn ..... B65B 9/06 53/550

(Continued)

FOREIGN PATENT DOCUMENTS

DE 19804226 C1 8/1999
DE 102019132878 A1 6/2021

(Continued)

OTHER PUBLICATIONS

International Search Report and Written Opinion for PCT/IB2022/059615 mailed on Jan. 3, 2023, 11 pages.

*Primary Examiner* — Joshua G Kotis
(74) *Attorney, Agent, or Firm* — Jacob M. Ward; Ward Law Office LLC

(57) ABSTRACT

The horizontal packaging apparatus comprises: a conveying line of products along a conveying direction; infeeding means of a continuous sheet; a forming device mounted on a support surface and comprising folding means for folding the continuous sheet to form a tubular wrapping; advancement means of the continuous sheet configured to advance the continuous sheet along an advancement direction concordant with the conveying direction of the products; pulling means arranged consecutively to the outfeed section of the forming device to bilaterally abut the facing end flaps of the lower portions of the tubular wrapping folded back beneath the products and advance the tubular wrapping wrapped around the products beyond the forming device. The reciprocal position between the support surface of the forming device and the pulling means is adjustable and variable to vary and adjust a distance between the outfeed section of the forming device and the pulling means.

13 Claims, 6 Drawing Sheets

(51) Int. Cl.

| | |
|---|---|
| ***B65B 35/24*** | (2006.01) |
| ***B65B 41/16*** | (2006.01) |
| ***B65B 51/30*** | (2006.01) |
| ***B65B 61/06*** | (2006.01) |

(56) References Cited

U.S. PATENT DOCUMENTS

| | | | | | |
|---|---|---|---|---|---|
| 5,255,495 | A * | 10/1993 | Kovacs | B65B 59/001 | 53/550 |
| 5,987,860 | A * | 11/1999 | Yang | B65B 9/067 | 53/550 |
| 6,457,300 | B1 * | 10/2002 | Yang | B65B 59/02 | 53/550 |
| 2006/0086067 | A1 * | 4/2006 | Limousin | B65B 9/067 | 53/442 |
| 2007/0186512 | A1 * | 8/2007 | Rimondi | B65B 9/073 | 53/550 |
| 2012/0289388 | A1 * | 11/2012 | Ehrmann | B29C 51/082 | 483/1 |
| 2016/0288937 | A1 * | 10/2016 | Grether | B65B 31/06 | |
| 2018/0029736 | A1 * | 2/2018 | Fioravanti | B65B 65/00 | |
| 2018/0086582 | A1 * | 3/2018 | Iida | B65B 9/06 | |
| 2018/0127132 | A1 * | 5/2018 | Cybart | B65B 61/188 | |
| 2021/0269182 | A1 * | 9/2021 | Orsini | B65B 9/067 | |
| 2023/0159194 | A1 * | 5/2023 | Lopes | B65B 9/22 | 53/550 |
| 2023/0174332 | A1 * | 6/2023 | Lopes | B65B 61/00 | 242/174 |

FOREIGN PATENT DOCUMENTS

| | | | | |
|---|---|---|---|---|
| JP | 2000203509 | A | * | 7/2000 |
| JP | 4932424 | B | | 5/2012 |

* cited by examiner

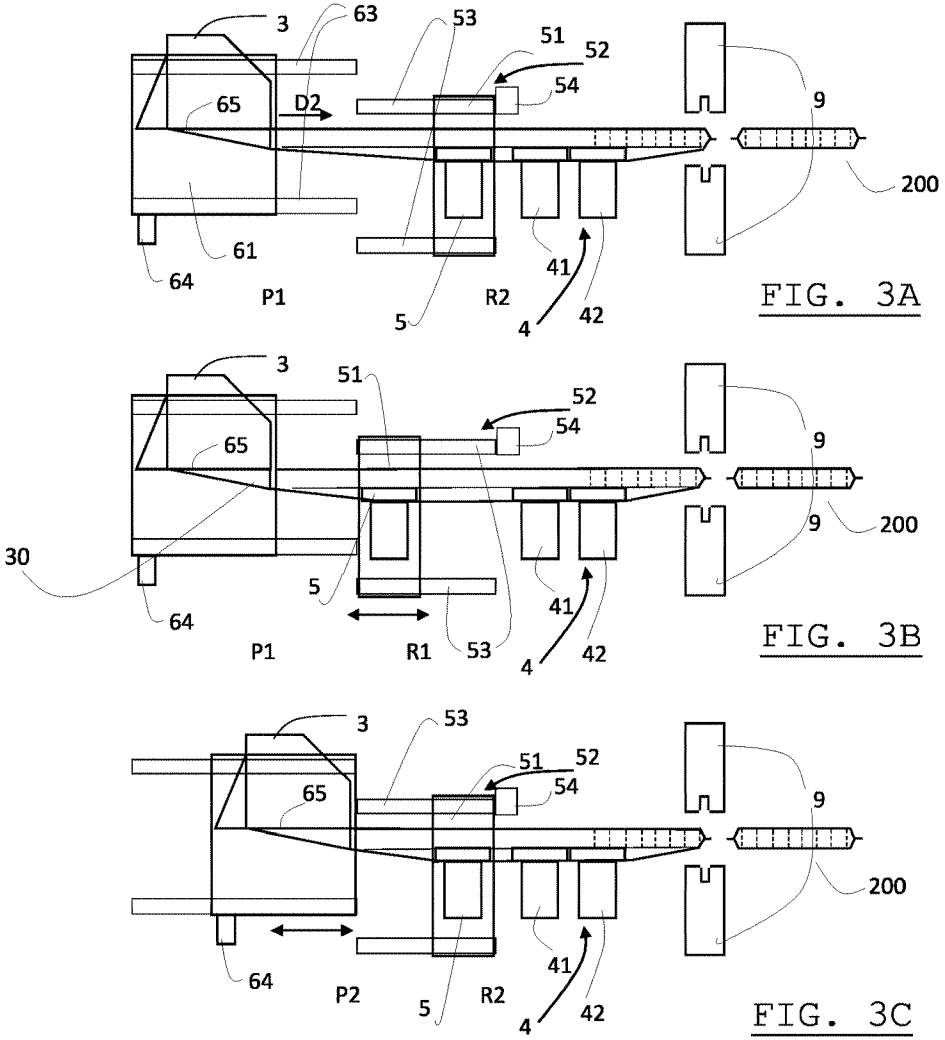
FIG. 3A
FIG. 3B
FIG. 3C
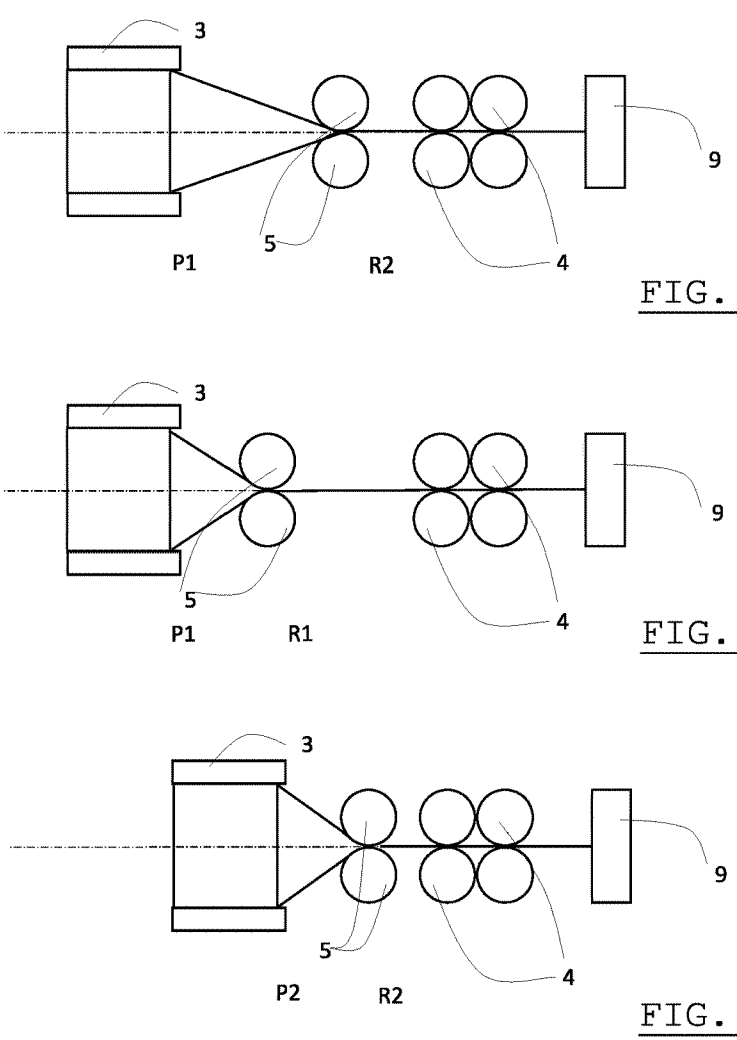
FIG. 4A
FIG. 4B
FIG. 4C

HORIZONTAL PACKAGING APPARATUS

FIELD OF THE INVENTION

The present invention relates to the technical sector concerning packaging of products in packaging material constituted by a continuous sheet, or film, which is wound about products to form a packaging, known as flow pack packaging.

To realise flow-packs, the continuous sheet of the packaging material is unwound from a relative reel and directed and advanced along an infeeding direction corresponding to the advancement direction of the products to be packaged.

During the advancement along the infeeding direction the continuous sheet of the packaging material is subjected to various folding and forming steps to form a tubular wrapping enveloping the products which are to be packaged and which are in advancement along the conveying line.

The folding and forming steps are directed to the folding of the continuous sheet in such a way as to obtain a tubular wrapping around the products comprising an upper portion, above the products, two lateral portions flanked to the products, and two lower portions folded back beneath the products, the end flaps thereof are folded and arranged facing one another in such a way as then to be reciprocally heat-welded.

The two heads of the tubular wrapping, thus-formed, with the relative product inside (or a stack or series of products), will then be folded and sealed for the forming of the final packaging.

DESCRIPTION OF THE PRIOR ART

A horizontal packaging apparatus of the prior art is described in document WO2021110604, of which a schematic figure is illustrated in FIG. 1.

This apparatus (A) comprises a conveying line (L) for conveying products (P), to be packed in a tubular wrapping, along a conveying direction (L1).

The packaging material, constituted by a continuous sheet (F), for example a film made of a plastic material or paper, is wound on a reel (B).

The apparatus (A) comprises means (M1) for unwinding and advancing the continuous sheet (F) which are configured and directed at unwinding the continuous sheet (F) of the packaging material from the relative reel (B) and feeding it along an infeeding direction (V) concordant with the conveying direction (L1) of the products to be packaged.

The means (M1) for unwinding and advancing are configured to bring the continuous sheet (F) above the products (P) to be packaged, in advancement along the conveying line (L), and to a forming device (D).

The forming device (D) is configured in such a way as each to comprise folding means of the continuous sheet (F) which are configured, and arranged with respect to the conveying line (L) of the products, in such a way as to fold the continuous sheet (F) to form a tubular wrapping (FT) which envelops the products and comprising an upper portion, arranged above the products, two lateral portions, flanked to the products, and two lower portions, which are folded back beneath the products, and which have the respective end flaps folded back and arranged facing one another.

In this regard the forming device (D) comprises folding plates appropriately positioned in a sequence with respect to one another and arranged with respect to the conveying line of the products, so as to abut portions of the continuous sheet during the advancement thereof along the infeeding direction, and fold back the continuous sheet to form the tubular wrapping described in the foregoing, to envelop the products internal thereof.

Immediately downstream, and consecutively to the forming device (D), the apparatus comprises pulling means (R), for example constituted by at least a pair of rollers drivable in rotation about the relative vertical rotation axes, which are arranged in such a way as to abut the facing flaps of the tubular wrapping and to pull the tubular wrapping downstream of the forming device (D).

Thereafter, downstream of the pulling means (R), welding means(S) are located, for example constituted by heated rollers, for welding the facing flaps of the tubular wrapping and cutting means (C) which are designed to cut and transversally weld the tubular wrapping and thus obtain respective flow-packs containing internally thereof a respective product of group of products.

The type of packaging material utilised has a considerable effect on the effectiveness of the folding and forming and also, especially, on the step of heat-welding the end flaps of the tubular wrapping.

In the case of use of the above-described apparatus for a single type of material, for example paper, this does not present particular issues.

Instead, in a case where it is desired to use the above-described apparatus both with paper-based continuous sheets, as well as with continuous sheets made of plastic material, drawbacks can arise due to the different behaviours of paper and plastic.

Patent JP4932424 also describes an apparatus having a limited flexibility of use for different materials.

SUMMARY OF THE INVENTION

The aim of the present invention is therefore to describe a novel horizontal packaging apparatus, for folding a continuous sheet of packaging material to form a tubular wrapping around products and thus to form respective flow-packs, which apparatus is effective and reliable independently of the type of material used, and therefore usable with both plastic materials, biopolymer materials or aluminium, in single or multi-material, and with paper-based materials, in single or multi-material. The cited aim is attained by means of a horizontal packaging apparatus according to the claims.

BRIEF DESCRIPTION OF THE DRAWINGS

The characteristics of a preferred, but not exclusive, embodiment of the horizontal packaging apparatus of the invention will be described in the following description with reference to the appended tables of drawings, in which:

FIGS. 3A, 3B, 3C illustrate a detail taken respectively from FIGS. 2A, 2B, 2C;

FIGS. 4A, 4B, 4C are a respective schematic view in plan view from above in respective operating configurations, as a function of the packaging material;

DESCRIPTION OF THE PREFERRED EMBODIMENTS

Figure 1:
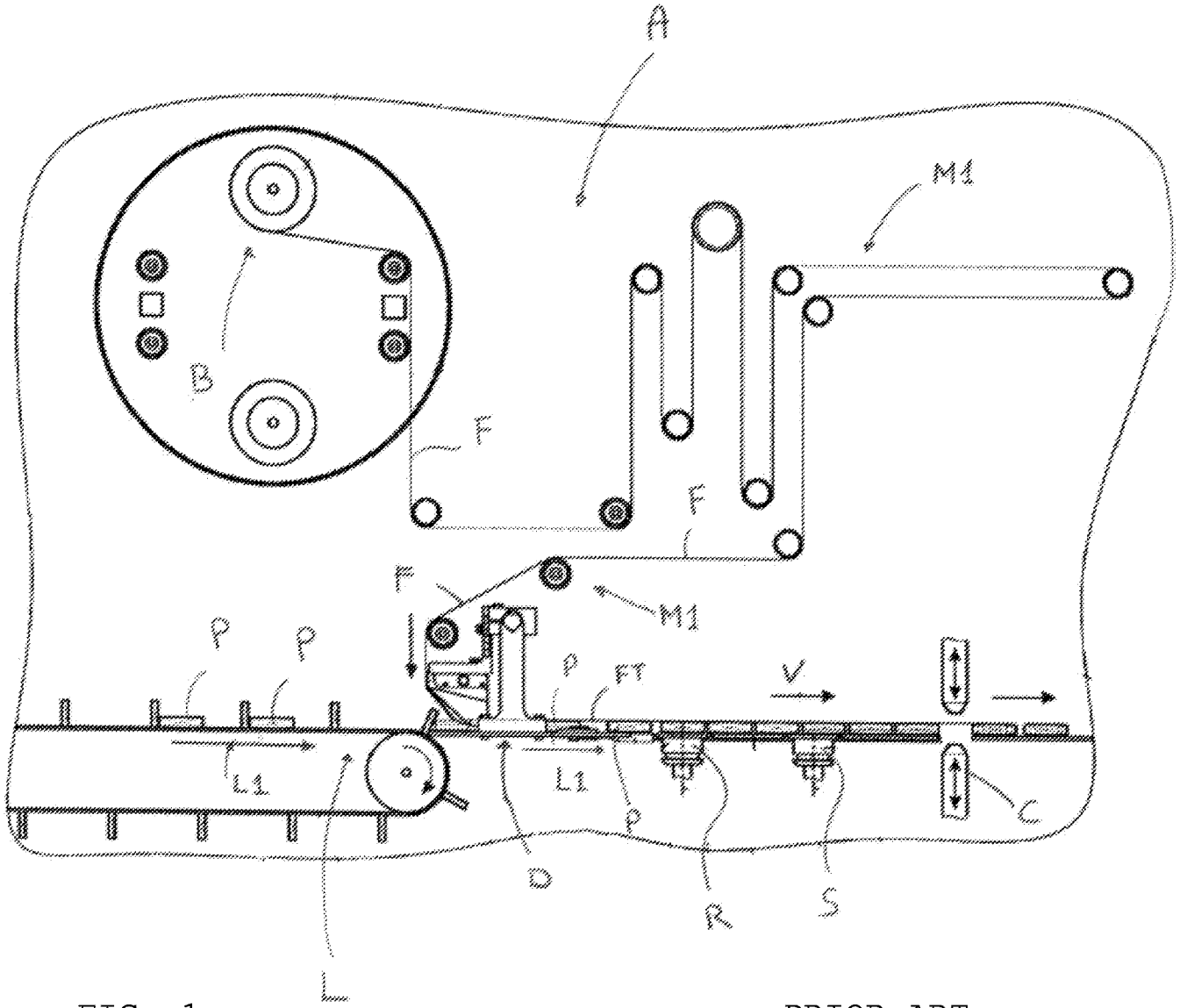
PRIOR ART FIG. 1
FIG. 1, as previously mentioned, illustrates, in a schematic lateral view, the horizontal packaging apparatus described in prior art document WO2021110604.

With reference to the accompanying tables of drawings, reference numeral (100) denotes the horizontal packaging apparatus of the present invention, in its entirety.

The apparatus (100) comprises:

a conveying line (1) of products to be packaged, configured to move the products along a conveying direction (D1);

infeeding means (2) of a continuous sheet(S) of packaging material, which are configured and arranged to unwind the continuous sheet(S) from a relative reel (SB) and to direct and arrange the continuous sheet(S) in a position superior of the conveying line (1) and therefore above the products;

a forming device (3), mounted on a support surface (65) and arranged along the conveying line (1) of the products and having an infeed section (I) and an outfeed section (O) and comprising folding means (30) (denoted only in FIG. 3B) arranged between the infeed section (I) and the outfeed section (O).

Advancement means of the continuous sheet(S) are included, configured to advance the continuous sheet(S) along an advancement direction (D2) concordant with the conveying direction (D1) of the products to cross the forming device (3) from the infeed section (I) to the outfeed section (O).

The folding means (30) of the forming device (3) are configured to intercept and abut the continuous sheet(S) and fold the continuous sheet(S) so as to form a tubular wrapping (T) around the products comprising an upper portion (T1), above the products, two lateral portions (T2, T3), flanked to the products, and two lower portions (T4, T5) folded back beneath the products and comprising respective end flaps (T6, T7) folded and facing one another.

The folding means (30) of the forming device (3) are constituted for example by a series of plates of known type and are therefore not illustrated in detail in the figures which are arranged consecutively to one another and appropriately configured to abut and fold the continuous sheet.

Figure 6:
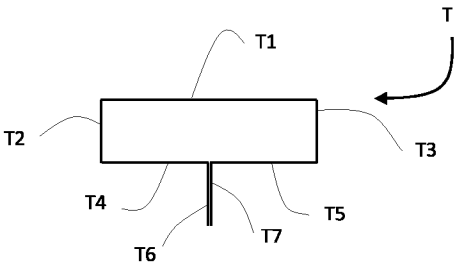
FIG. 6 is a view along section plane VI-VI of FIG. 5 and shows the tubular wrapping obtained by the folding of the continuous sheet of the packaging material.
Figure 5:
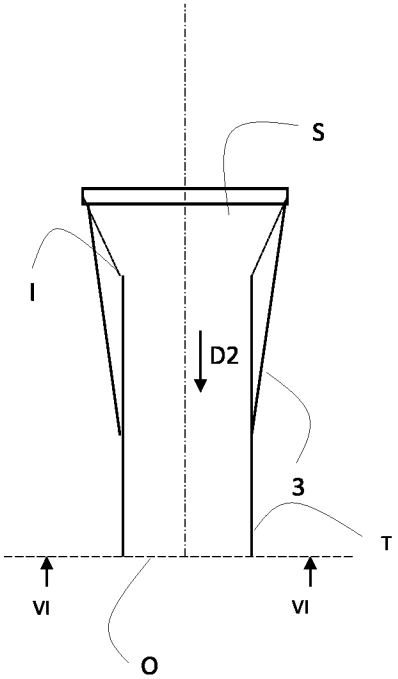
FIG. 5 illustrates, in a schematic view in plan view from above, the steps of folding the continuous sheet of the packing material to form a tubular wrapping carried out by the horizontal packaging apparatus of the invention.

FIG. 5 schematically illustrates, in a view from above, the folding of the continuous sheet(S) carried out by a forming device (3), while FIG. 6 illustrates, according to section plane VI-VI of FIG. 5, the shape of the tubular wrapping (T) at the outfeed (O) of the forming device (3), obtained following the folding of the continuous sheet(S).

The advancement means comprise pulling means (5) which are arranged consecutively to the outfeed section (O) of the forming device (3) which are configured to abut the end flaps (T6, T7), folded and facing one another, of the lower portions (T4, T5) folded back beneath the products, and therefore to pull and thus advance the tubular wrapping (T), wrapped around the products, beyond the outfeed section (O) of the forming device (3).

The apparatus (100) also comprises welding means (4) (for example constituted by a pair of welding rollers facing one another and drivable in counter-rotation about respective vertical rotation axes) which are arranged consecutively to the pulling means (5), and configured to bilaterally abut and weld the facing end flaps (T6, T7) of the lower portions (T4, T5) of the tubular wrapping (T) folded back beneath the products.

The apparatus (100) further comprises cutting/welding means (9), arranged downstream of the welding means (4), configured to abut the tubular wrapping (T) in such a way as to weld it and cut it transversally, generating final wrappings.

The special characteristics of the apparatus (100) of the invention consist in the fact that at least one from between the support surface of the forming device (3) and the pulling means (5) is movable in such a way as to be able to vary the reciprocal position between the forming device (3) and the pulling means (5) in a moving away or a nearing direction along the conveying direction (D1) and, consequently:

i) to vary the relative distance between the welding means (4) with respect to the forming device (3) when the forming device (3) is moved and/or ii) to vary the relative distance between the welding means (4) with respect to the pulling means (5) when the pulling means (5) are moved.

In this way, according to the type of the packaging material used for the packaging (whether a plastic packaging material, single-layer, laminated or coupled, or aluminium, or paper-based, single-layer or multi-material), with the apparatus of the invention it is possible to regulate and vary the distance between the outfeed of the forming device (3) and the pulling means (5) of the just-formed tubular wrapping, a circumstance which enables the continuous sheet of packaging material to assume and maintain the tubular shape received from the folding device, and consequently make the subsequent welding action of the welding means effective. Therefore, the apparatus of the invention is able to adapt to the type of packaging material which is to be used time by time for packaging the products, in any case guaranteeing the effectiveness of the folding to form the tubular wrapping and maintain the given tubular shape, in particular the reciprocal position of the facing end flaps of the lower portions of the tubular wrapping folded back beneath the products, which facilitates the subsequent welding thereof.

For example, the apparatus can be configured in such a way as to set a reciprocal distance between the outfeed of the forming device (3) and the pulling means (5) at a predefined optimal value for the use of packaging materials that are more rigid and non-extensible, such as for example paper-based, in single-layer or multi-layer material (FIGS. 2A, 3A), and in the case of subsequent use of packaging materials that are more flexible and extensible, such as plastic packaging materials, the apparatus can be subsequently configured in such a way as to reduce the distance between the outfeed of the forming device (3) and the pulling means (5) (FIGS. 2B, 2C, 3B, 3C).

Figure 2A:
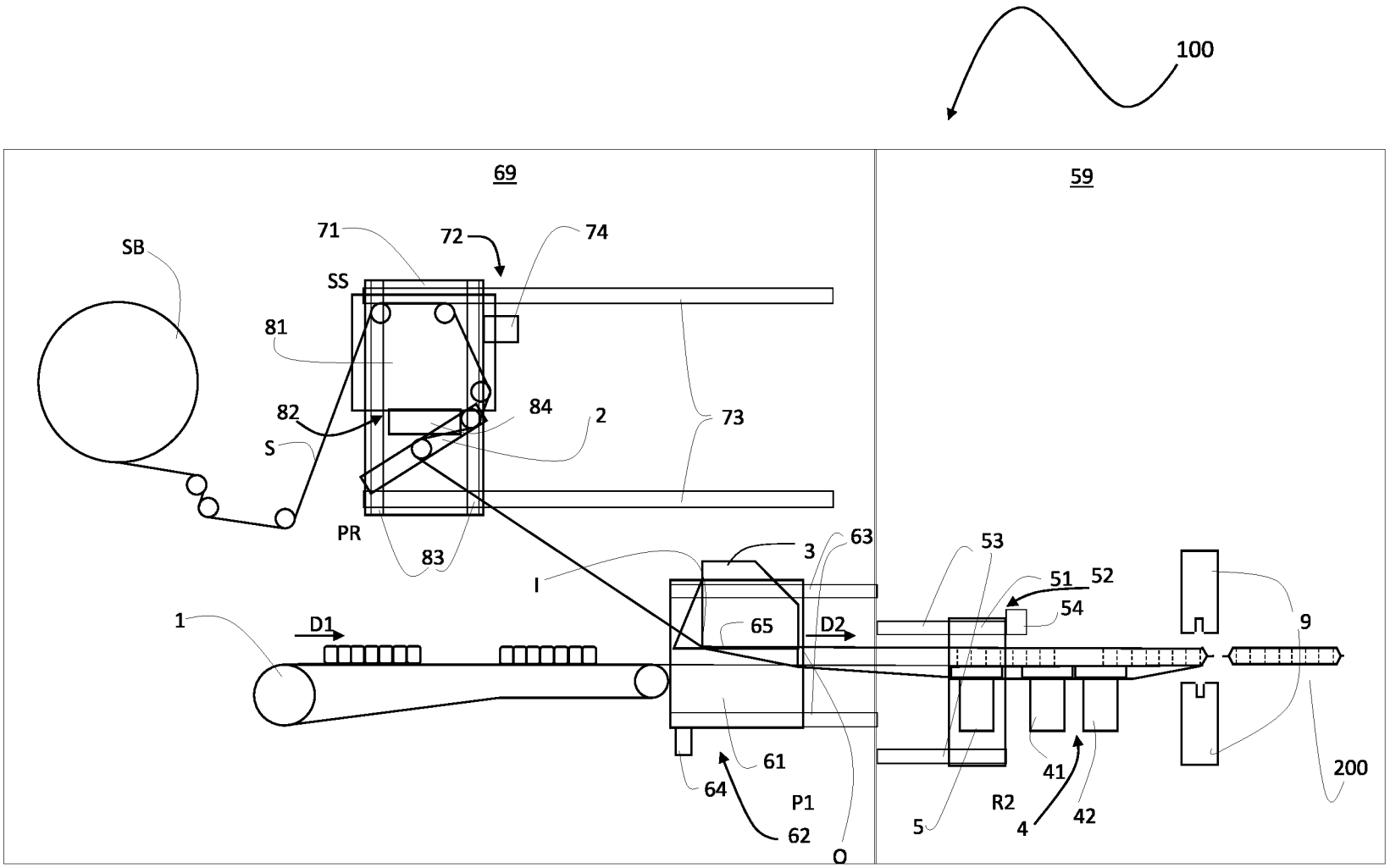
FIGS. 2A, 2B, 2C illustrate, in a schematic lateral view of the horizontal packaging apparatus of the invention in respective operating configurations, as a function of the packaging material.

Alternatively, the apparatus can be configured in such a way as to set a reciprocal distance between the outfeed of the forming device (3) and the pulling means (5) at a predefined optimal value for the use of packaging materials that are more flexible and extensible, such as plastic packaging materials (FIGS. 2B, 2C, 3B, 3C), and in the case of subsequent use of packaging materials that are more rigid and non-extensible, such as for example paper-based, in single-layer or multi-layer material, the apparatus can be subsequently configured in such a way as to increase the distance between the outfeed of the forming device (3) and the pulling means (5) (FIGS. 2A, 3A).

In any case, the distance between the welding means (4) and the cutting/welding means (9), both being mounted fixed on the apparatus (100), remains invariable independently of the packaging material used. This configuration advantageously facilitates the sealing of the products in the tubular wrapping (T), reducing the possibility of displacement of the products internally of the tubular wrapping (T) between the welding means (4) and the cutting/welding means (9).

In fact, an excessive distancing between the welding means (4) and the transversal cutting/welding means (9) might facilitate an undesired displacement of the products internal of the tubular wrapping during the advancement, before the transversal welding is done.

Preferred and advantageous aspects of the apparatus provided by the invention are described in the following.

The pulling means (5) comprise at least a pair of drawing rollers arranged in such a way as to be drivable in rotation about the respective vertical rotation axes and in such a way as to bilaterally abut the facing end flaps (T6, T7), folded and facing one another, of the two lower portions (T4, T5) folded beneath the products, so as to carry out thereon a pulling action and thus advance the tubular wrapping beyond the forming device (FIG. 6).

In an embodiment, the drawing rollers of the pulling means (5) can also be of the pre-heatable type, so as to be able to pre-heat the end flaps and facilitate the subsequent welding.

The welding means (4) can also comprise two pairs of welding rollers arranged consecutively to one another and at an unvaried distance, as a first pair (41) is used for the preheating and a second pair (42) (downstream of the first) for the welding of the packaging material.

The apparatus (100) of the preferred embodiment is realised and configured in such a way as to be able to move the pulling means (5) with respect to the support surface (65) on which the forming device (3) is mounted so as to vary and regulate the distance between the outfeed section (O) of the forming device (3) and the pulling means (5).

In a further possible embodiment, the apparatus (100) can also be realised and configured in such a way that the pulling means (5) are fixed, with the support surface (65) on which the forming device (3) is mounted, which is configured and arranged in such a way as to be movable with respect to the pulling means (5) so as to be able to vary and adjust a distance between the pulling means (5) and the outfeed section (O) of the forming device (3) on the support surface (65).

In the preferred embodiment, in which the movement of the pulling means (5) is included with respect to the support surface (65) on which the forming device (3) is mounted, the apparatus (100) comprises a fixed first support wall (59), arranged vertically, a first frame (51) that bears the pulling means (5) and which is mounted slidably on the first support wall (59).

First movement means (52) are provided for moving the first frame (51) with respect to the first support wall (59) in such a way as to position the first frame (51), and therefore the pulling means (5), with respect to the support surface (65) (which bears the forming device (3)) between a first position (R1) in which the outfeed section (O) of the forming device (3) is at a minimum distance from the pulling means (5) (see for example FIGS. 3B, 4B) and a second position (R2), in which the outfeed section (O) of the forming device (3) is at a maximum distance away from the pulling means (5) (see for example FIGS. 3A, 4A). In this case, there is a consequent change of distance between the pulling means (5) and the welding means (4).

The first movement means (52) are preferably configured in order to move the first frame (51) with respect to the first support wall (59) and to position the first frame (51), and thus the pulling rollers (5), in any intermediate position comprised between the first position (R1) and the second position (R2).

For example, the movement of the first frame (51) and the positioning thereof in any intermediate position between the first position (R1) and the second position (R2) can be carried out in continuous mode or discrete mode (i.e. with a series of set intermediate positions).

In the preferred but not exclusive embodiment, the first movement means (52) comprise at least a first linear sliding guide (53), in the illustrated example two, arranged parallel to the advancement direction (D2) of the continuous sheet (S), with the first frame (51) being slidably mounted on the first sliding guide (53), with the first movement means (52) further comprising a first linear driving means (54) in order to move the first frame (51) alternatingly along the first sliding guide (53).

For example, the first linear driving means (54) can be constituted by an acme screw or a worm screw, activatable manually or by means of a relative actuator means.

In the embodiment which also includes the movement of the support surface (65) on which the forming device (3) is mounted, the apparatus (100) further comprises a fixed second support wall (69), arranged vertically, a second frame (61) which bears the support surface (65) on which the forming device (3) and which is mounted slidably on the second support wall (69).Second movement means (62) are provided for moving the second frame (61) with respect to the second support wall (69) in such a way as to position the second frame (61), and therefore the support surface (65) on which the forming device (3) is mounted, with respect to the pulling means (5) between a first position (P1), in which the outfeed section (O) of the forming device (3) is at a distance away from the pulling means (5) (see for example FIGS. 2A, 3A, 4A) and a second position (P2), in which the outfeed section (O) of the forming device (3) is at a distance neared to the pulling means (5) (see for example FIGS. 2C, 3C, 4C), holding the pulling means (5) in the second position (R2).

In this alternative embodiment, the second movement means (62) comprise at least a second linear sliding guide (63), arranged parallel to the advancement direction (D2) of the continuous sheet(S), with the second frame (61) being slidably mounted on the second sliding guide (63), the second movement means (62) further comprising a second linear driving means (64) to move the second frame (61) alternatingly along the second sliding guide (63).

In a further preferred aspect, the apparatus (100) can be made in such a way as to comprise a third frame (71), which bears the infeeding means (2) of the continuous sheet(S) and which is slidably mounted on the second support wall (69), and third movement means (72) for the movement of the third frame (71), and therefore of the infeeding means (2) of the continuous sheet(S), with respect to the pulling means (5), between an advanced position (PA) and a retracted position (PR).

In this way, it is possible to regulate the position of the infeeding means (2) of the continuous sheet(S) as a function of the material of which the sheet(S) is made and of the position of the support surface (65) on which the forming device (3) is mounted, in particular of the position of the infeed section (I) thereof.

In this regard, the third movement means (72) are preferably configured, when the first movement means (52) move and position the first frame (51) in the second position (R2), to move and position the third frame (71) in the retracted position (PR) (see for example FIG. 2A), should for example a sheet of paper material be used and are also configured, when the first movement means (52) move and position the first frame (51) in the first position (R1), to move and position the third frame (71) in both a position (PP), interposed between the advanced position (PA) and the retracted position (PR) (see for example FIG. 2B), should for example a sheet of plastic material be used.

Figure 2B:
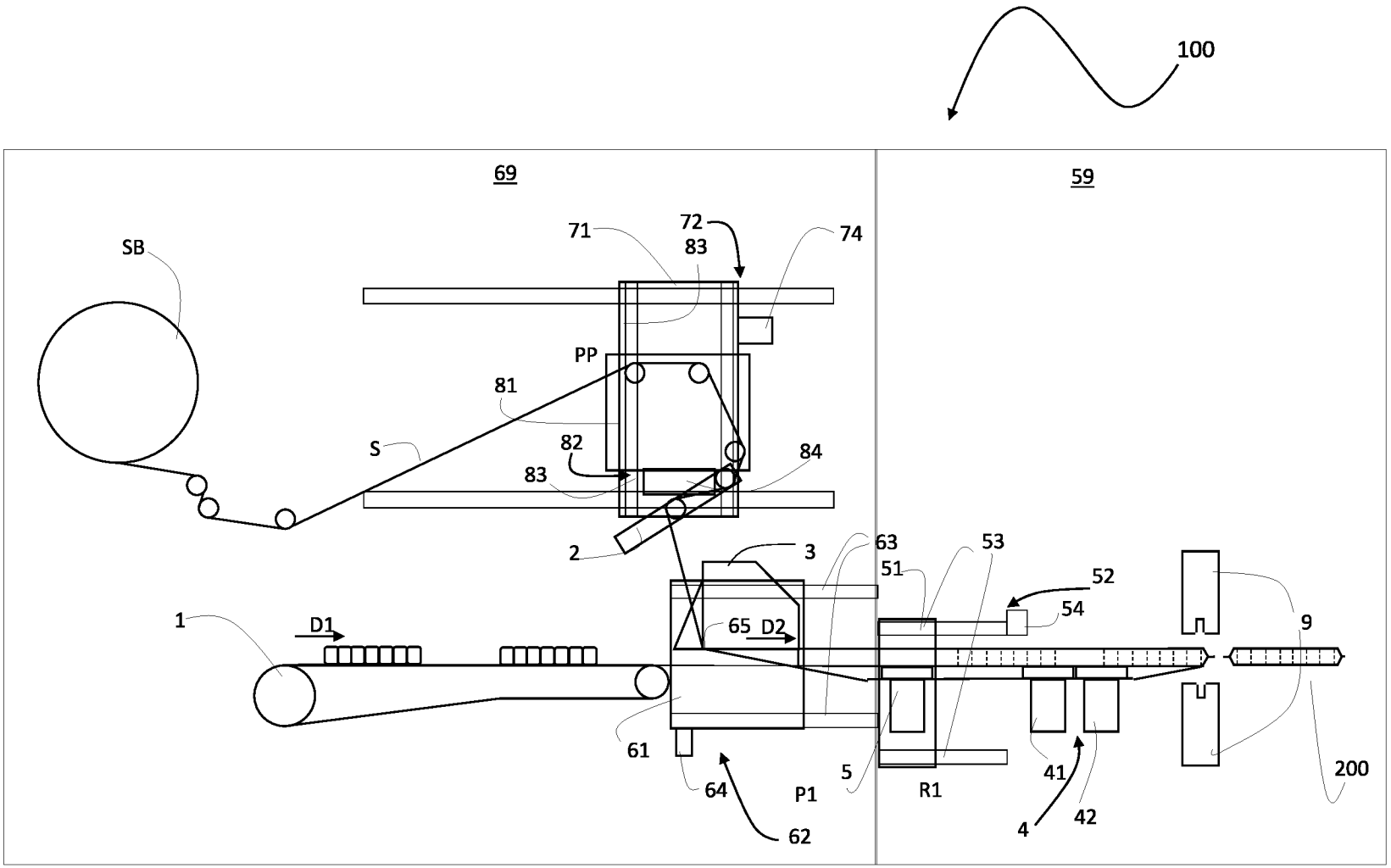
Figure 2C:
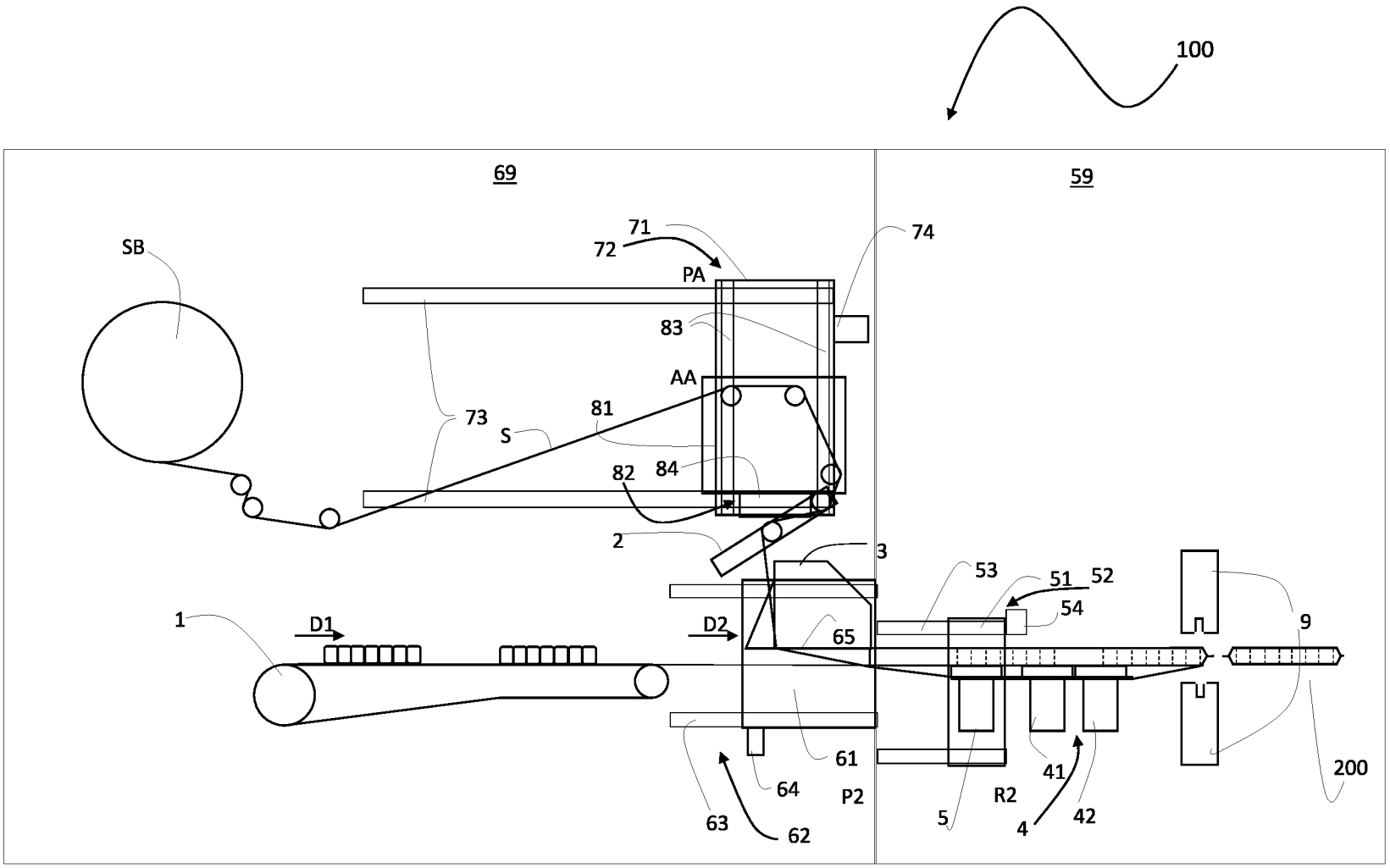

In the preferred, illustrated in FIGS. 2A-2C, the third movement means (72) comprise at least a third linear sliding guide (73), for example two in the illustration, arranged parallel to the advancement direction (D2) of the continuous sheet(S), with the third frame (71) being slidably mounted on the third sliding guide (73), and which the third movement means (72) further comprise a third linear driving means (74) for moving the third frame (71) alternatingly along the third sliding guide (73).

For example, the third driving means (74) can be constituted by an acme screw or a worm screw, activatable manually or by means of a relative actuator means.

In a further preferred and advantageous aspect, the infeeding means (2) of the continuous sheet(S) are mounted on a fourth frame (81), which is mounted vertically slidably on the third frame (71).

In this case, the apparatus (100) comprises fourth movement means (82) for the movement of the fourth frame (81), and therefore of the infeeding means (2) of the continuous sheet(S), with respect to the third frame (71), between a lowered position (AA) (see for example FIG. 2C) and a raised position (SS) (see for example FIG. 2A).

This enables, on the basis of the effective type of the packaging material used, regulating the position of the infeeding means of the continuous sheet with respect to the position of the infeed section (I) of the forming device and thus regulating the entry angle of the continuous sheet into the forming device.

With this specification, it is possible to avoid forming cusps and thus reduce the stresses on the continuous sheet, this being a particularly useful and effective circumstance in the case of use of a paper-based continuous sheet, in either single or multi-materials, as a packaging material.

In the preferred, but not exclusive embodiment, the fourth movement means (82) comprise at least a fourth linear driving means (83), in the example two in number, arranged vertically, with the fourth frame (81) being slidably mounted on the fourth sliding guide (83), with the fourth movement means (82) further comprising a fourth linear driving means (84) for vertically moving the fourth frame (81) along the fourth sliding guide (83).

For example, the fourth driving means (84) can be constituted by a acme screw or a worm screw, activatable manually or by means of a relative actuator means.

Also in the possible further embodiment, mentioned in the foregoing, in which the apparatus is realised and configured in such a way that the support surface (65) on which the forming device (3) is mounted is drivable, to move away from or towards the pulling means (5) which, in this case, are fixed, the infeeding means (2) of the continuous sheet(S) can be mounted on respective frames predisposed in such a way as to be able to move the infeeding means (2) both between the advanced position (PA) and the retracted position (PR), with respect to the pulling means (5), and between the raised position (SS) and the lowered position (AA), with respect to the forming device, in such a way as to be able to adapt the angle of inclination of infeeding of the continuous sheet according to the type of material used.

In any of the above-described embodiments, the forming device (3) stably fixed on the support surface (65) is also demountable so as to be replaced by another forming device (3) having a different configuration in the event of a material change, so that the folding means (30) are optimised for the packaging material utilised. Further, given a same packaging material, the packaging material can be changed with one having a configuration suitable for packaging a product of different dimensions.

The invention claimed is:

1. A horizontal packaging apparatus comprising:

a conveying line of products to be packaged, configured to move the products along a products conveying direction;

infeeding means of a continuous sheet of packaging material, configured and arranged to unwind the continuous sheet from a relative reel and to direct and arrange the continuous sheet in a position above the conveying line and therefore above the products;

a forming device, fixedly mounted on a support surface and arranged along the conveying line of the products and having an infeed section and an outfeed section and comprising folding means arranged between the infeed section and the outfeed section;

advancement means of the continuous sheet, configured to advance the continuous sheet along an advancement direction concordant with the conveying direction of the products to cross the forming device from the infeed section to the outfeed section;

wherein the folding means of the forming device are configured to intercept and abut the continuous sheet and fold the continuous sheet so as to form a tubular wrapping around the products comprising an upper portion, above the products, two lateral portions, flanked to the products, and two lower portions folded back beneath the products and comprising respective end flaps folded and facing one another;

wherein the advancement means comprise pulling means arranged consecutively to the outfeed section of the forming device which are configured to abut the end flaps, folded and facing one another, of the lower portions folded back beneath the products, to pull and thus advance the tubular wrapping, wrapped around the products, beyond the outfeed section of the forming device;

welding means, arranged consecutively to the pulling means, and configured to bilaterally abut and weld the facing end flaps of the lower portions of the tubular wrapping folded back beneath the products;

cutting/welding means, arranged downstream of the welding means, configured to abut the tubular wrapping so as to transversally cut and weld the tubular wrapping in order to create final wrappings;

a first vertical support wall;

a first frame which bears the pulling means and which is mounted slidably on the first vertical support wall;

first movement means for moving the first frame with respect to the first vertical support wall and thus for moving the pulling means towards and away with respect to the support surface of the forming device in a moving away or nearing direction parallel to the products conveying direction so that the pulling means are movable between a first position, wherein the pulling means are at a minimum distance from the outfeed section of the forming device, and a second position, wherein the pulling means are at a maximum distance from the outfeed section of the forming device and consequently to vary the relative distance between the welding means with respect to the pulling means when the pulling means are moved, further comprising a fixed second support wall, a second frame which bears the support surface on which the forming device is mounted and which is mounted slidably on the second support wall, second movement means for moving the second frame with respect to the second support wall in such a way as to position the second frame, and therefore the support surface on which the forming device is mounted, with respect to the pulling means between a first position, wherein the outfeed section of the forming device is at a distance away from the pulling means, and a second position, wherein the outfeed section of the forming device is at a distance nearer to the pulling means.

2. The apparatus as claimed in claim 1, wherein the welding means and the cutting/welding means are arranged at a fixed distance from one another.

3. The apparatus as claimed in claim 1, wherein the first movement means comprises at least a first sliding guide and wherein the first frame is slidably mounted on the at least first sliding guide and activated by a first linear driving means to slide alternatingly along a parallel direction to the products conveying direction.

4. The apparatus as claimed in claim 1, wherein the forming device is fixed on the support surface and is dismountable so as to be replaced by another forming device having a different configuration.

5. The apparatus as claimed in claim 1, wherein the welding means comprise a preheating unit and, consecutively, a welding unit, at a fixed distance from one another.

6. The apparatus as claimed in claim 1, wherein the second movement means are configured in order to move the second frame with respect to the second support wall and to position the second frame, and therefore the support surface on which the forming device is mounted, in any intermediate position comprised between the first position and the second position of the second frame.

7. The apparatus as claimed in claim 1, wherein the second movement means comprise at least a second linear sliding guide, arranged parallel to the advancement direction of the continuous sheet, with the second frame being slidably mounted on the second sliding guide, the second movement means further comprising a second linear driving means to move the second frame alternatingly along the second sliding guide.

8. The apparatus as claimed in claim 1, wherein the fixed second support wall is a fixed second vertical support wall; a third frame, which bears the infeeding means of the continuous sheet and which is slidably mounted on the fixed second vertical support wall above the conveying line of products and above the forming device; and third movement means for the movement of the third frame, and therefore of the infeeding means of the continuous sheet, with respect to the pulling means, between an advanced position and a retracted position along a parallel direction to the products conveying direction, wherein the third movement means comprise at least a third linear sliding guide, arranged parallel to the advancement direction of the continuous sheet, with the third frame being slidably mounted on the third sliding guide, with the third movement means further comprising a third linear driving means for moving the third frame alternatingly along the third sliding guide.

9. The apparatus as claimed in claim 8, wherein the infeeding means of the continuous sheet are mounted on a fourth frame, which is mounted vertically slidably on the third frame, and comprising fourth movement means for the movement of the fourth frame, and therefore of the infeeding means of the continuous sheet, with respect to the third frame, between a lowered position and a raised position respectively in moving towards and away from the conveying line.

10. The apparatus as claimed in claim 9, wherein the fourth movement means comprise at least a fourth linear driving means, arranged vertically, with the fourth frame being slidably mounted on the fourth sliding guide, with the fourth movement means further comprising a fourth linear driving means for vertically moving the fourth frame along the fourth sliding guide.

11. A horizontal packaging apparatus comprising:

a conveying line of products to be packaged, configured to move the products along a products conveying direction;

infeeding means of a continuous sheet of packaging material, configured and arranged to unwind the continuous sheet from a relative reel and to direct and arrange the continuous sheet in a position above the conveying line and therefore above the products;

a forming device, fixedly mounted on a support surface and arranged along the conveying line of the products and having an infeed section and an outfeed section and comprising folding means arranged between the infeed section and the outfeed section;

advancement means of the continuous sheet, configured to advance the continuous sheet along an advancement direction concordant with the conveying direction of the products to cross the forming device from the infeed section to the outfeed section;

wherein the folding means of the forming device are configured to intercept and abut the continuous sheet and fold the continuous sheet so as to form a tubular wrapping around the products comprising an upper portion, above the products, two lateral portions, flanked to the products, and two lower portions folded back beneath the products and comprising respective end flaps folded and facing one another;

wherein the advancement means comprise pulling means arranged consecutively to the outfeed section of the forming device which are configured to abut the end flaps, folded and facing one another, of the lower portions folded back beneath the products, to pull and thus advance the tubular wrapping, wrapped around the products, beyond the outfeed section of the forming device;

welding means, arranged consecutively to the pulling means, and configured to bilaterally abut and weld the facing end flaps of the lower portions of the tubular wrapping folded back beneath the products;

cutting/welding means, arranged downstream of the welding means, configured to abut the tubular wrapping so as to transversally cut and weld the tubular wrapping in order to create final wrappings;

a first vertical support wall;

a first frame which bears the pulling means and which is mounted slidably on the first vertical support wall;

first movement means for moving the first frame with respect to the first vertical support wall and thus for moving the pulling means towards and away with respect to the support surface of the forming device in a moving away or nearing direction parallel to the products conveying direction so that the pulling means are movable between a first position, wherein the pulling means are at a minimum distance from the outfeed section of the forming device, and a second position, wherein the pulling means are at a maximum distance from the outfeed section of the forming device and consequently to vary the relative distance between the welding means with respect to the pulling means when the pulling means are moved, further comprising a fixed second vertical support wall; a third frame, which bears the infeeding means of the continuous sheet and which is slidably mounted on the fixed second vertical support wall above the conveying line of products and above the forming device; and third movement means for the movement of the third frame, and therefore of the infeeding means of the continuous sheet, with respect to the pulling means, between an advanced position and a retracted position along a parallel direction to the products conveying direction, wherein the third movement means comprise at least a third linear sliding guide, arranged parallel to the advancement direction of the continuous sheet, with the third frame being slidably mounted on the third sliding guide, with the third movement means further comprising a third linear driving means for moving the third frame alternatingly along the third sliding guide.

12. The apparatus as claimed in claim 11, wherein the infeeding means of the continuous sheet are mounted on a fourth frame, which is mounted vertically slidably on the third frame, and comprising fourth movement means for the movement of the fourth frame, and therefore of the infeeding means of the continuous sheet, with respect to the third frame, between a lowered position and a raised position respectively in moving towards and away from the conveying line.

13. The apparatus as claimed in claim 12, wherein the fourth movement means comprise at least a fourth linear driving means, arranged vertically, with the fourth frame being slidably mounted on the fourth sliding guide, with the fourth movement means further comprising a fourth linear driving means for vertically moving the fourth frame along the fourth sliding guide.

* * * * *